United States Patent [19]

Meyer

[11] 4,094,467

[45] June 13, 1978

[54] SPRINKLER HEAD SELECTIVELY OPERABLE IN A PART-CIRCLE MODE OR A FULL CIRCLE MODE

[75] Inventor: Larry P. Meyer, Walla Walla, Wash.

[73] Assignee: Nelson Irrigation Corporation, Walla Walla, Wash.

[21] Appl. No.: 783,758

[22] Filed: Apr. 1, 1977

[51] Int. Cl.[2] ..... B05B 3/08

[52] U.S. Cl. ..... 239/230; 239/212; 239/236; 239/DIG. 1

[58] Field of Search ..... 239/212, 230, 233, 236, 239/DIG. 1

[56] References Cited

U.S. PATENT DOCUMENTS

| | | | |
|---|---|---|---|
| 2,691,547 | 10/1954 | Campbell | 239/230 |
| 3,477,643 | 11/1969 | Broninga | 239/1 |
| 3,559,887 | 2/1971 | Meyer | 239/233 |
| 3,592,388 | 7/1971 | Friedlander | 239/233 |
| 3,623,666 | 11/1971 | Meyer | 239/230 |
| 3,669,353 | 6/1972 | Hanson et al. | 239/233 X |

*Primary Examiner*—Robert W. Saifer
*Attorney, Agent, or Firm*—Cushman, Darby & Cushman

[57] ABSTRACT

A sprinkler head having a reversing mechanism cooperable with spaced cam assemblies for effecting part circle mode operation in which the cam element of one of the cam assemblies is selectively movable by a spring pressed over center toggle linkage between two positions, one of which causes the sprinkler head to operate in a part circle mode and other of which causes the sprinkler head to operate in a full circle mode.

13 Claims, 5 Drawing Figures

Fig. 1
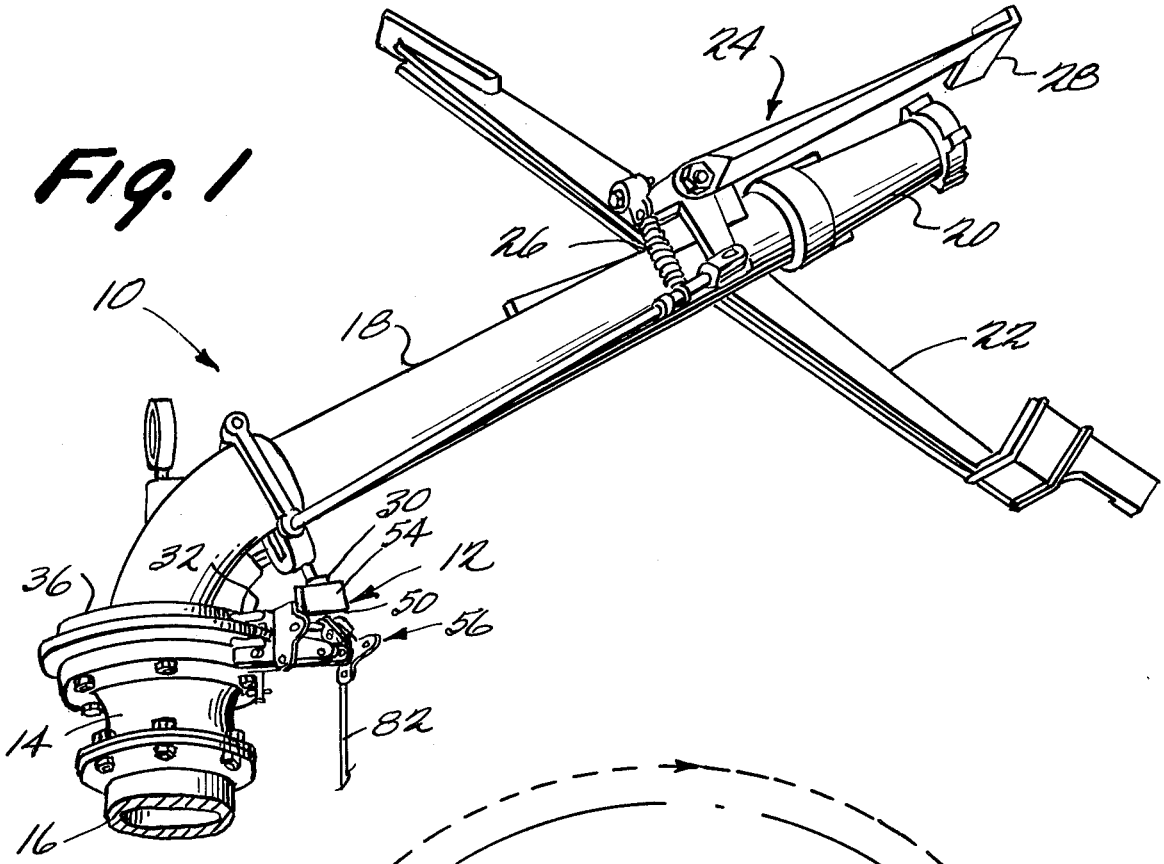
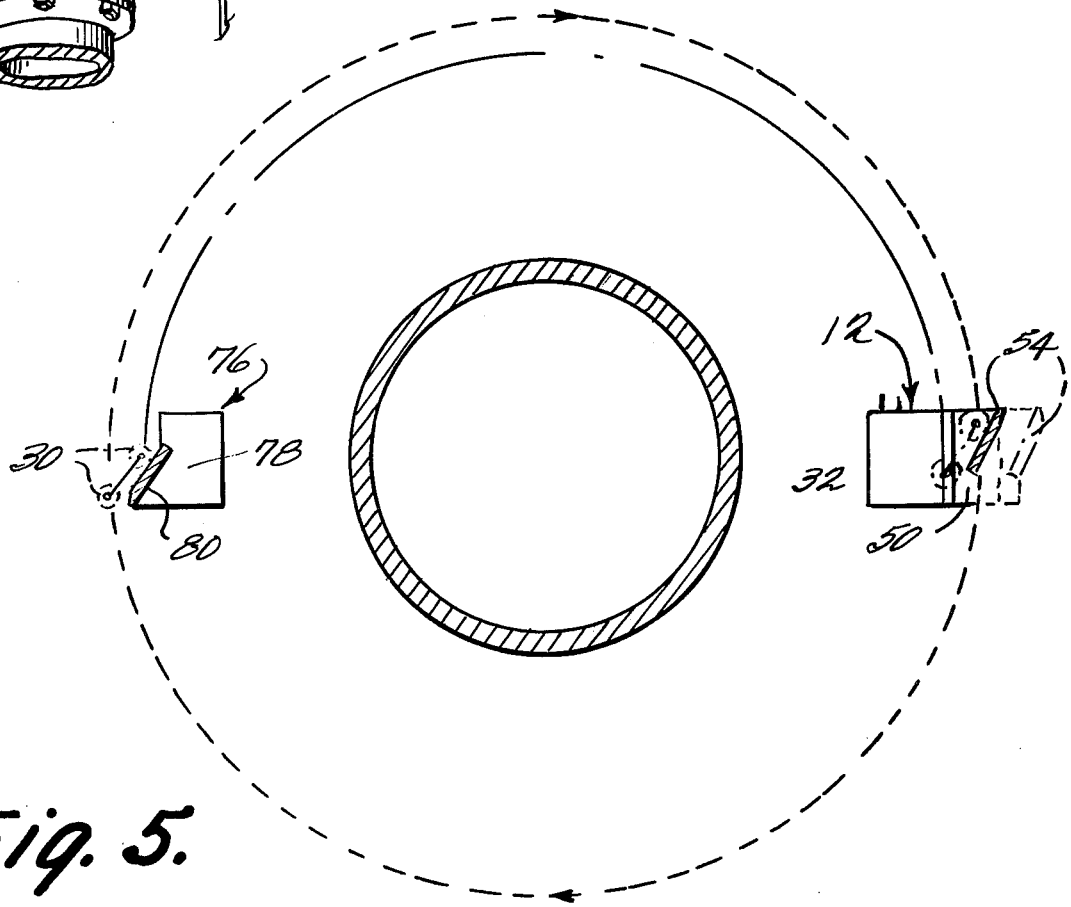
Fig. 5.

18
24
54
30
70
32
34
56
50
52
68
66
64
42
40
74
36
72
60
58
38
62
48
46
44
82
14
16

SPRINKLER HEAD SELECTIVELY OPERABLE IN A PART-CIRCLE MODE OR A FULL CIRCLE MODE

This invention relates to sprinkler heads and more particularly to high capacity sprinkler heads of the type used in traveling sprinkler systems.

An exemplary embodiment of the type of sprinkler head herein contemplated is disclosed in U.S. Pat. No. 3,559,887. It will be noted that the sprinkler head is a rotary step-by-step type sprinkler head in which the operative step-by-step movement is accomplished by engagement of an impulse arm having a reactant surface with the stream issuing from the nozzle of the sprinkler head. The sprinkler head contemplates operation in a part-circle mode, the mechanism provided for effecting the return movement being a reactant element by which the return is effected with a continuous rapid movement. As disclosed, the sprinkler head embodying the reverse mechanism is intended for operation within a part-circle mode at all times. For the purpose of effecting part-circle operation there is provided a pair of adjustable cam elements for engagement by a cam follower roller. The cam elements are mounted on the stationary housing of the sprinkler head for manual movement into any desired position of adjustment where they are manually clamped to the stationary housing. The clamp permits the cam elements to be removed from the fixed housing structure in which case the sprinkler head is capable of operating in a full circle mode.

In the past few years sprinkler heads of the type disclosed in U.S. Pat. No. 3,559,887 have been utilized extensively in various traveling sprinkler systems. An example of a system of this type is disclosed in U.S. Pat. No. 3,477,643. In arrangements of this type a sprinkler head is carried on a wheeled vehicle frame and connected with a source of water under pressure in a field by means of an elongated flexible hose. In operation, the wheeled vehicle is placed in the field at a position remote from the water source pipe with one end of the hose connected to the water source pipe and the opposite end thereof looped around and connected with the rear of the vehicle. The usual arrangement includes a water motor on the vehicle between the rear hose connection and the sprinkler head, which water motor is used to power a cable and winch assembly by which the wheeled vehicle is moved along a straight path which includes a first portion extending to a position adjacent the source pipe and a second portion extending away from the source pipe.

During this movement, the wheeled vehicle pulls the portion of the hose looped around and connected to its rear end, which portion gradually increases from a relatively short section at the beginning to substantially the entire hose at the end. The hose and the water therein therefore applies drag force to the wheeled vehicle which, at the beginning, is very low and then increases gradually to a relative high value at the end.

It is usual in the operation of traveling sprinkler systems to utilize the sprinkler head in a part-circle mode, the pattern being approximately 330° with the non-operative segment of 30° being disposed in a position forwardly of the vehicle frame with respect to its path of travel. This operation insures that the wheels will be moving on dry soil, rather than soil which has been wetted, although full circle operation with the wheels moving in mud can be used. In actual operation, it has been found to be necessary to provide for a braking control of the wheeled vehicle during the initial start-up period of the operating cycle. The reason for the provision of the braking capability is that when the sprinkler head reaches a position such that the stream is directed with a substantial component in the rearward direction, there is a tendency for the reactant force of the sprinkler head to move the vehicle frame forwardly because the hose drag force has not yet increased sufficiently to be equal to the reactant force of the sprinkler.

In at least one embodiment of the existing traveling sprinkler systems, a yieldable connection is provided between the end of the flexible hose and the vehicle. When the hose drag force reaches a predetermined value sufficient to overcome the sprinkler head reactant force, the connection yields a predetermined distance and this movement is utilized as a signal for disengaging the brakes of the wheeled vehicle so that the remainder of the cycle can be carried out without the unnecessary drag applied thereby. Mechanisms of this type are expensive to provide but have been regarded as necessary in order to preserve the automatic operation of the system and eliminate the necessity of the utilization of manual labor.

Considering one operative cycle of these traveling sprinkler systems, the overall sprinkler pattern is in the form of an elongated rectangle with the trailing end of semi-circular configuration and the leading end of either segmented semi-circular configuration, as when the part-circle mode is utilized, or full semi-circular configuration as when the full circle mode is utilized. These end sprinkler pattern configurations are not always desirable. Indeed, at start-up the operator has the choice of either starting with the vehicle frame and sprinkler head advanced from the end of the field a distance equal to the radius of the full circle head sprinkler pattern, in which case the corners of the ends of the field will not receive any water, or he may start the sprinkler head at the end of the field, in which case the water distributed in the rear half-circle of the sprinkler pattern is simply wasted. Of course, the operator may choose to compromise between the two extreme positions and in many situations the first option must be chosen for the reason that the area in back of the field may be a state road or a neighbor's plot which should not be encroached upon. In aggravated situations of this type it is possible for the operator to set the cam elements of the sprinkler head initially at positions which will provide for a half-circle sprinkler pattern extending in a direction forwardly of the direction of travel of the vehicle. However, after the period of movement equal to one radius of the sprinkler head pattern it becomes necessary for the operator to go out into the field, shut the system down, and re-set the cam elements to the 330° setting. As previously indicated, the requirement to provide manual labor during the operating cycle is considered to be highly undesirable.

It is an object of the present invention to provide a sprinkler head of the type described having improved means for selectively operating the sprinkler head either in a part-circle mode or a full circle mode. The type of mode selectivity herein contemplated is the type which would enable a sprinkler head of the type previously described to be selectively changed from a part-circle mode to a full circle mode automatically in response to a predetermined movement signal such as the hose drag movement signal previously mentioned. The sprinkler head of the present invention, when used in a traveling sprinkler system, enables the system to automatically change from a part-circle mode operation to a full circle mode operation without the necessity of any manual adjustments requiring that the system be shut down.

It is recognized that small capacity step-by-step sprinkler heads of the impact type suitable for use on lawns and other turf areas, have embodied reversing mechanisms carried by the rotary structure of the head which include a stop contacting member movable between two positions, one which renders the reversing mechanism operable in a part-circle mode, and the other position rendering the reversing mechanism inoperable so that the sprinker head operates in a full-circle mode. An example of an arrangement of this type is disclosed in U.S. Pat. No. 2,691,547 (see wire reversing member 58). These well-known arrangements are not suitable for the present purposes contemplated for essentially two reasons. First, the sprinkler heads involved are not of a capacity such as would be useful in a traveling sprinkler system, and second, the member which is moved for the purpose of determining the mode of operation is carried by and moved with the rotating structure of the head. Sprinkler heads of this type do not provide reversing cam elements but rather, instead, reversing stop elements which are not effective when high capacity flows are encountered as would be the case in a traveling sprinkler system.

It has been proposed to modify the mounting of the cam elements in a high capacity sprinkler head of the type herein contemplated, as exemplified in U.S. Pat. No. 3,669,353. The modification disclosed in this patent is for the purpose of providing a particular cyclic movement of the sprinkler head which includes in each cycle a part-circle mode operation and a full circle mode operation. Here again, the arrangement and purpose is quite different from that herein contemplated.

The objects of the present invention are obtained by mounting the cam element which serves to move the cam roller follower of the reversing mechanism from the arcuate path which it normally takes when in a full circle mode into the reversing position, between an operative position wherein the reversing function takes place and a second position out of the arcuate path of movement of the cam follower roller so as to permit continued full circle operation. With this capability, it becomes possible to simply connect the motion signal, such as the aforesaid hose drag motion signal, with the movable cam element to automatically change the mode of operation of the sprinkler head from a part-circle mode to a full circle mode.

With the presently contemplated sprinkler head improvements it becomes possible to eliminate the provision of the braking control of the traveling sprinkler system by setting the cam elements of the sprinkler head in an initial position of part-circle mode operation with the sprinkler pattern being semi-circular and directed forwardly of the vehicle. When the movement signal of the hose drag occurs, this movement signal can then be applied to the cam element, thus automatically selecting full circle mode operation for the remainder of the cycle of operation of the traveling sprinkler system. The sprinkler head of the present invention thus makes it possible to provide a traveling sprinkler system in which the braking mechanism is eliminated by eliminating the condition which required the provision of the braking mechanism in the first place. By simply providing a single cam element movement, the braking mechanism can be eliminated by providing for initial semi-circular part-circle mode operation and subsequent full circle mode of operation. This simple method of achieving the elimination of the braking mechanism has the disadvantage that the wheeled vehicle must operate in wetted soil. By providing a similar movement for the other cam element and by providing either two additional cam elements or for automatic movement of the two movable cam elements into different positions of arcuate adjustment, the full circle mode operation can be changed to the desirable 330° part-circle mode of operation.

In accordance with the principles of the present invention, it is preferred to provide for the movement of the movable cam element between its part-circle mode position and full-circle mode position by means of a spring pressed over-center toggle linkage. This preferred construction insures that the cam element is moved from one position to another in response to the movement signal and is retained into the position into which it has been moved.

Another object of the present invention is the provision of a sprinkler head of the type described having an improved spring pressed over-center toggle linkage for moving a cam element selectively between a part-circle mode position and a full circle mode position which is simple in construction, economical to manufacture and maintain and effective in operation.

These and other objects of the present invention will become more apparent during the course of the following detailed description and appended claims.

The invention may best be understood with reference to the accompanying drawings, wherein an illustrative embodiment is shown.

In the drawings:

FIG. 1 is a perspective view illustrating a sprinkler head embodying the principles of the present invention;

FIG. 5 is a diagrammatic view illustrating the position of the cam element and the path of movement of the cam follower roller when in both a part-circle mode and a full circle mode.

Figure 2:
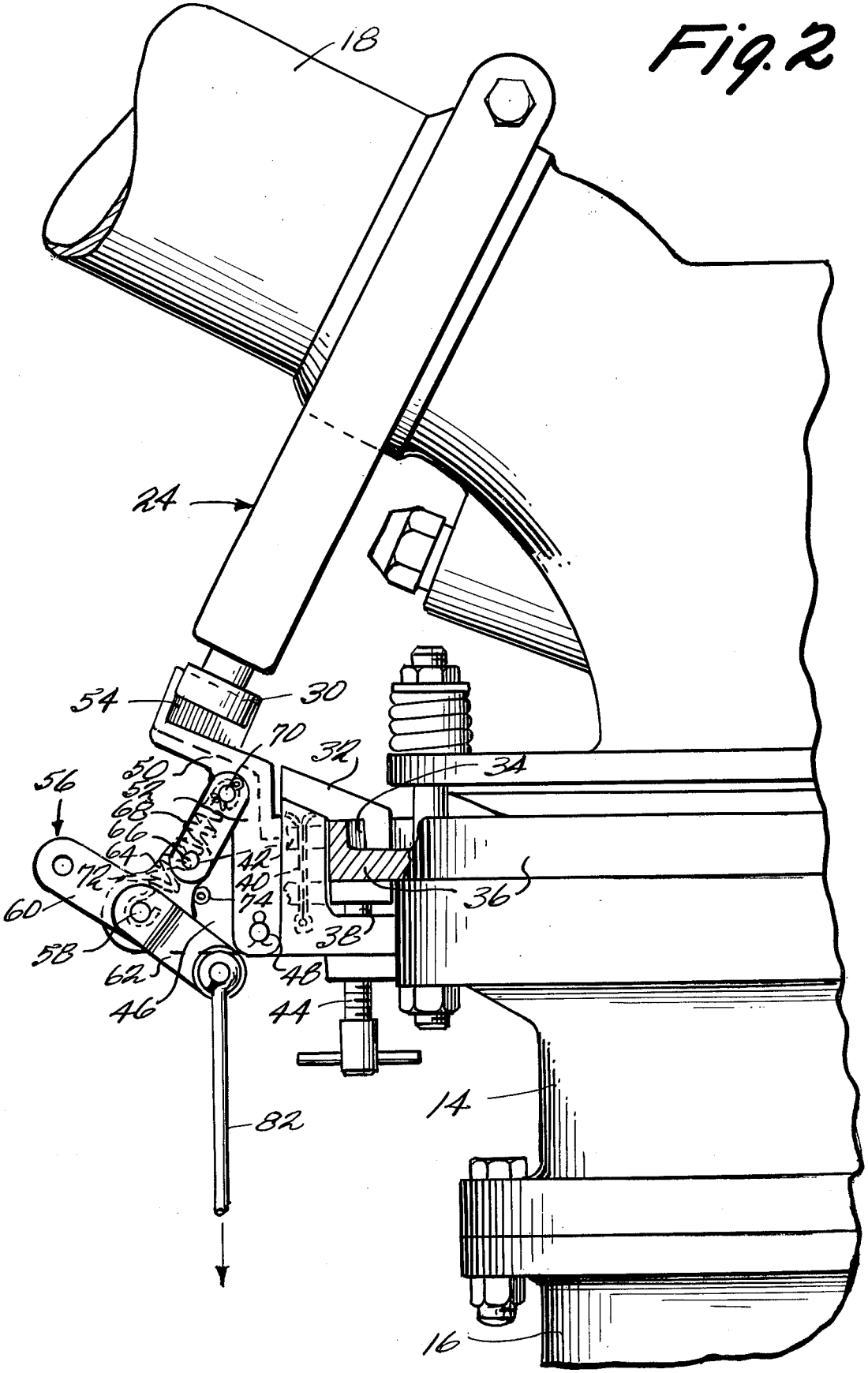
FIG. 2 is an enlarged fragmentary side elevational view of a portion of the sprinkler head shown in FIG. 1 with certain parts broken away for purposes of clearer illustration.

Referring now more particularly to FIG. 1 of the drawings, there is shown therein a sprinkler head 10, of the type herein contemplated which embodies the principles of the present invention. As shown the sprinkler head 10 is constructed like the part circle sprinkler head disclosed in U.S. Pat. No. 3,559,887 except that the cam assembly normally provided for initiating the reverse part circle movement of the sprinkler head is replaced by a mode selector cam assembly, generally indicated at 12 which embodies the principles of the present invention.

It will be understood that the sprinkler head of U.S. Pat. No. 3,559,887 while constituting a preferred sprinkler head is merely exemplary and that any known type and style of sprinkler head may be utilized so long as it meets the capacity requirements previously stated. Moreover, while the principles of the present invention have particular advantages as aforesaid in high capacity application such as traveling sprinkler systems, the invention may be used to advantage in other high capacity installations such as solid set agricultural irrigation systems and the like as well as other installation where high capacity is not demanded.

A detailed description of the structure and operation of the sprinkler head 10 (aside from the mode selector cam assembly 12) is not believed essential in order to obtain an understanding of the present invention. For any details deemed necessary, reference may be made to the specification and drawings of U.S. Pat. No. 3,559,887, the disclosure of which is hereby incorporated by reference into the present specification. For present purposes it is sufficient to note that the sprinkler head 10 includes a stationary frame structure 14, which is adapted to be connected with a riser pipe 16 communicated with a source of water under pressure, and a rotating body structure 18 which includes a nozzle 20 from which the water under pressure communicating with the inlet provided by the stationary structure flows as a stream directed upwardly and outwardly with respect to the vertical axis of rotation of the rotating structure 18. The sprinkler head 10 also includes an oscillating impulse arm mechanism 22 which functions, by virtue of its periodic engagement with the stream issuing from the nozzle, to effect an operative step by step rotational movement of the rotating structure 18 about its vertical axis under the control of a brake mechanism (not shown) and a reversing mechanism 24, which functions, likewise, by virtue of its operative engagement with the stream 20 issuing from the nozzle 20, to effect a continuous rapid return part circle movement of the rotating sprinkler head structure.

The reversing mechanism 24 includes a spring 26 which normally biases the mechanism 24 into an inoperative or full circle mode position as shown in FIG. 1. The reversing mechanism 24 also includes a stream engaging reactant element 28 which not only serves to effect the aforesaid rapid continuous return movement but also to provide a biasing force sufficient to overcome the bias of spring 26 to maintain the reversing mechanism 24 in its operative position until the return movement is completed (except when the water is shutoff during the return movement). Finally, it will be noted that the reversing mechanism 24 includes a cam follower roller 30 which moves rotationally with the rotating structure 18 about the vertical axis of rotation in a first arcuate path (shown schematically in dotted lines in FIG. 5) when the reversing mechanism 24 is in its inoperative or full circle mode position and in a second arcuate path (shown schematically in phantom lines in FIG. 5) spaced from the first arcuate path when the reversing mechanism 24 is in its operative or reversing position.

The mode selector cam assembly 12 consists essentially of an arcuately adjustable and clamped mounting structure, a movable cam structure and a spring pressed over center toggle linkage for effecting movement of the cam structure with respect to the mounting structure. The mounting structure is preferably in the form of a carrier member 32 of cast metal or the like having an undercut recess 34 formed in the leading face thereof providing the same with a generally C-shaped cross sectional configuration. The recess 34 is of a size and shape to receive therein a peripheral portion of an annular flanged member 36, forming a part of the stationary structure 14 of the sprinkler head, so as to permit the carrier member to be moved arcuately along the member 36 into a desired position of adjustment. As shown, the recess 34 is also sized to receive therein below the member 36 one leg of an L-shaped clamping plate 38, the other leg of which is apertured to receive therethrough a retaining cotter pin 40 suitably suspended from an apertured leg 42 on the carrier member 36. The portion of the carrier member 32 below the clamping plate 38 is suitably centrally bossed and provided with a vertically extending threaded bore which receives a threaded clamping member 44. The clamping member 44, when tightened, serves to maintain the carrier member 32 in the position of arcuate movement along the annular member 36 to which it has been adjusted and, when loosed, permits the aforesaid adjusting movement.

Extending rearwardly from the carrier member 32 is a pair of horizontally spaced mounting lugs 46, the forward lower portion of which are horizontally apertured to receive a pivot pin or shaft 48. The cam structure is preferably in the form of a unitary pivoted member 50 of cast metal or the like having a pair of horizontally spaced depending mounting legs 52, the lower ends of which are horizontally apertured to receive the ends of the pivot pin 48. Extending upwardly from the pivoted member 50 is an inclined cam element 54. The pivot pin 48 thus serves to mount the member 50 on the carrier member 32 for pivotal movement between a part circle mode position (shown in solid lines in FIG. 5), wherein the cam element 54 is disposed within the first arcuate path of the cam follower roller 30 so as to be operable during the operative step by step movement of the rotating structure when engaged by the roller 30 to move the latter out of its first path toward its second path and a full circle mode position wherein the cam element 54 is disposed out of the arcuate first of the roller 30 so as to permit a continuous step by step operative movement of the rotating structure. As previously noted, the operation of the reversing mechanism 24 is such that the reversing mechanism is biased to remain in whatever position it is moved by the cam element 54 until positively removed therefrom.

In order to effect movement of the cam element 54 between the part circle mode position and the full circle mode position there is preferably provided, as aforesaid, a spring pressed over center toggle linkage which includes a bell crank lever, generally indicated at 56 pivoted on one end of a horizontal shaft 58 mounted on the outer ends of the lugs 46. The bell crank lever 56 includes two actuating arms 60 and 62 and a third intermediate arm 64 which forms one link of the toggle. The outer end of the arm 64 is pivotally interconnected, as indicated at 64, with one end of a pair of parallel links 68, the opposite end of which is pivotally interconnected to one end of a horizontal pivot pin or shaft 70 mounted in the pivoted member 50. Over center spring pressure is applied by a helical coil spring 72 of the tension type having its ends connected respectively to the central portions of the shafts 58 and 70. A stop pin 74 is mounted horizontally in the central portion of the lugs 46 in a position such that its ends will be engaged by the legs 52 of the pivoted member 50 when the latter is in its full circle mode position (FIG. 3) and one end thereof will be engaged by the bell crank arm 64 when the pivoted member 50 is in its part circle mode position (FIG. 2).

It will be understood that a second cam assembly, generally indicated at 76 in FIG. 5, is provided for the purpose of moving the cam follower roller 30 from its second path back into its first path at the end of the return movement of the rotating sprinkler head structure 18. As shown, the cam assembly 76 includes an adjustably clamped carrier member 78 having an integral inclined cam element 80. The cam element 80 is disposed in any position of annular adjustment within the second arcuate path of movement of the roller 30 but out of the first arcuate path of movement of the roller 30. This latter relationship is important not only to provide the overriding action mentioned in U.S. Pat. No. 3,559,887 with respect to the cam 220 but to insure full circle mode operation when the cam element 54 is disposed in its full circle mode position.

OPERATION

Since the most advantageous utilization of the present sprinkler head 10 is in a traveling sprinkler system, an exemplary operation will be described in relation to such use. Assuming the direction of forward travel of the vehicle of the system, reference to FIG. 5, to be toward the upper end of the sheet of drawings, the cam assemblies 12 and 76 are initially clamped to the annular member 36 in the positions shown with the arrows indicating the direction of operative step by step rotational movement and continuous rapid return movement in a broken line path and phantom line path respectively. It will be noted that the assembly 12 is initially set with the pivoted member 50 in its part circle mode position with the cam element 54 disposed in the first arcuate path of movement of the roller 30 of the return mechanism 24. Assuming that the water is turned on with the nozzle 20 extending forwardly, the water issuing from the nozzle will activate impulse arm assembly 22 to commence an operative step by step rotational movement of the rotating structure 18 in a clockwise direction. During this movement the return mechanism 24 is biased by spring 26 to remain in the inoperative position shown in FIG. 1 with the roller 30 in a full circle mode position moving along the dotted line path. When the roller 30 reaches cam element 54 it is moved from its full circle mode position within the first dotted line path toward its part circle mode position within the second phantom line path. It will be noted that the spring pressed over center toggle linkage of the assembly 12 holds the cam element 54 rigidly in its part circle mode position thereby insuring the above mentioned movement of the roller 30.

As the roller 30 is moved by the cam element 54, reactant element 28 enters the water. The impingement of the stream on reactant element creates a reactant force having components in two directions. One reaction force component is sufficient to override the bias of the spring 26 and to bias and maintain the reactant element 28 fully within the stream during which movement roller 30 is correspondingly biased and maintained in its part circle mode position within the second phantom line path. The other reactant force component is sufficient to override the operation of the impulse arm assembly 22 and effect the continuous rapid return movement of the rotating structure 18 in a counterclockwise direction until roller 30 engages cam element 80. This engagement causes roller 30 to move away from its part circle mode position within the second phantom arcuate path toward its full circle position within the first path. During this movement, the reactant element 28 is moved out of the water stream, thus removing the reactant force bias and allowing spring 26 to take over and bias the reversing mechanism 24 back into its inoperative position. With the roller 30 thus biased and maintained in its full circle mode position the operation of the impulse arm assembly 22 is now effective to commence the operative step by step rotational movement of the rotating structure 18.

Figure 3:
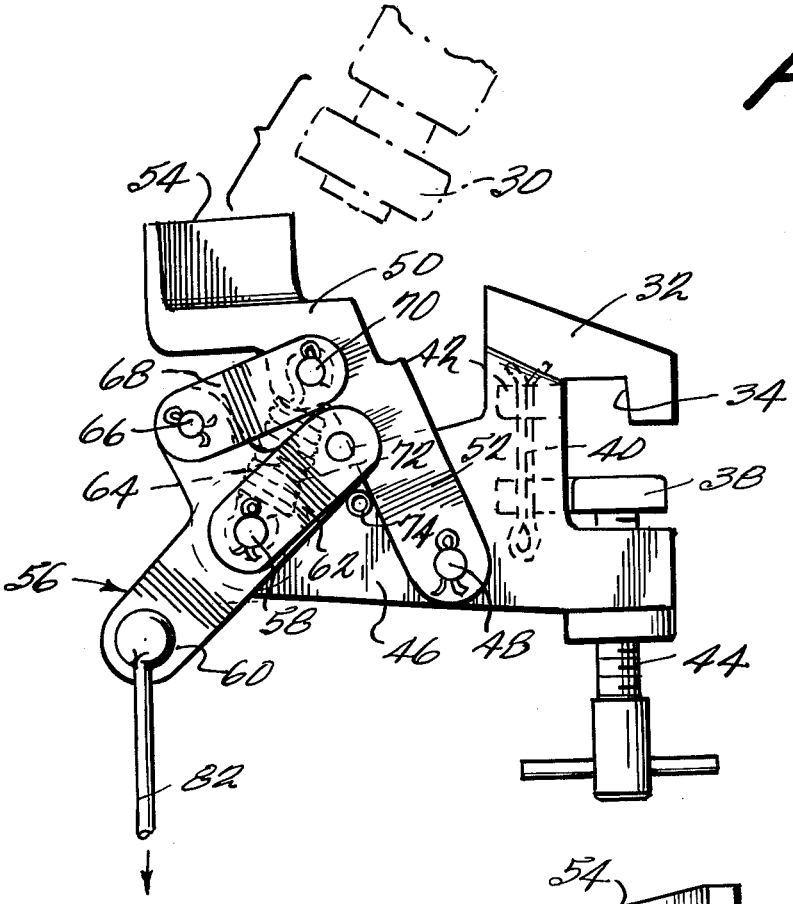
FIG. 3 is a side elevational view of the movable cam element and the spring pressed toggle linkage for moving the same, showing the position of the parts in their full-circle mode position.
Figure 4:
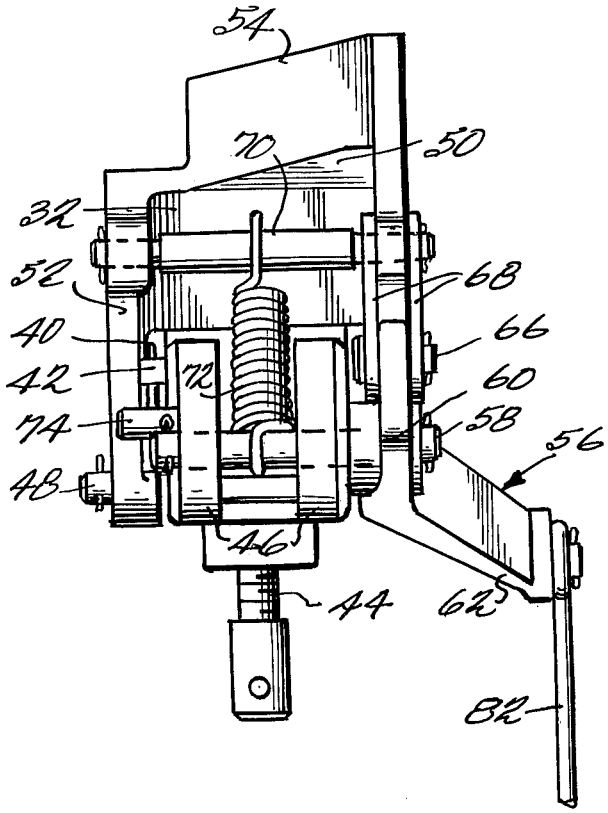
FIG. 4 is an end view of the structure shown in FIG. 3.

One complete cycle of part circle mode operation is thus completed and the sprinkler head will continue to repeat this cycle during the initial movement of the vehicle of the traveling sprinkler system. It will be noted that all of the water issuing from the nozzle 20 is directed within a semicircular pattern extending forwardly of the vehicle so that the nozzle 20 never reaches a position where the reaction force of the water issuing therefrom is applied to the vehicle with a rearward component. By eliminating this condition which is normally encountered with the sprinkler head of the system either in full circle mode operation or the conventional 330° part circle mode operation, the provision of a braking assembly for the vehicle can likewise be eliminated. Moreover, since the cam assembly 12 is carried by the stationary structure 14 of the sprinkler head 10 which likewise is mounted in fixed relation to the vehicle frame of the system, the movement signal normally used to automatically disengage the normally provided braking assembly can be used to automatically change the mode of operation of the sprinkler head 10 form its part circle mode to its full circle mode. For this purpose the movement signal is transmitted, as by a connecting rod 82, to one of the actuating arms 60 or 62. Where the movement signal is transmitted by a tensile movement or pull on the connecting rod, which is the preferred manner, the rod 82 is connected to the end of the arm 60 as shown in FIG. 3. Prior to the movement, the over center toggle linkage is disposed in the position shown in FIG. 2 with the spring 72 acting to bias the arm 64 into engagement with stop 74. As the rod is pulled down, the pivot 66 of the toggle linkage provided by arm 64 and links 68 moves over center so that spring 72 now acts to bias the leg 52 of the pivoted member 50 into engagement with the step 74.

Referring again to FIG. 5, when the cam element 54 is moved into its full circle mode position as shown in dotted lines, the cam element is disposed out of the first dotted line path of the cam follower roller 30 thus allowing the cam roller to move past the cam element when it next reaches this position in its operative step by step movement along the first dotted line path. It will also be noted that since the other cam element is disposed out of the first dotted line path, the sprinkler head 10 will continue to operate in a full circle mode until the vehicle of the traveling sprinkler system reaches the end of its travel.

It can thus be seen that there has been provided a sprinkler head which is selectively operable in either a part circle mode or full circle mode, the arrangement being such that selectivity can be readily achieved automatically as in the traveling sprinkler system embodiment described. While a simple movement of a single cam element carrying pivoted member between part circle and full circle mode positions by a spring pressed over center toggle linkage is preferred, it will be understood that the other cam element 80 may be provided with a similar two position capability if desired. Moreover, by providing two pairs of cooperating two position cam elements automatic conversion from a forward semicircular part circle pattern to a conventional 330° part circle pattern can be obtained.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

I claim:

1. A sprinkler head selectively operable in a part-circle mode or a full circle mode comprising:

a sprinkler body having an inlet and an outlet;

stationary means for mounting said sprinkler body for controlled rotational movement about a generally vertical axis with said inlet in communication with a conduit arranged to communicate a source of water under pressure therewith;

said outlet being disposed to direct water under pressure communicated with said inlet in a stream flowing therefrom in a direction upwardly and outwardly in generally symmetrical relation to a plane passing through the axis of rotation;

cam follower means mounted on said sprinkler body for movement with respect thereto between (1) a first position wherein said cam follower means moves rotationally with said sprinkler body along a first arcuate path and (2) a spaced second position wherein said cam follower means moves rotationally with said sprinkler body along a second arcuate path spaced from said first arcuate path, means operable by the flow of water communicated with said sprinkler body (1) for effecting a movement of said sprinkler body about its axis in one direction of rotation when said cam follower means is disposed in said first position, (2) for effecting a movement of said sprinkler body about its axis in the other direction of rotation when said cam follower means is disposed in said second position, and (3) for providing a yielding bias on said cam follower means to maintain the same in either one of its positions during the movement of said sprinkler body in the corresponding direction of rotation;

first and second adjustable means mounted on said stationary means for independent movement with respect to each other into any one of a plurality of variably spaced fixed positions of arcuate adjustment with respect to the axis of rotation of said sprinkler body, first cam means carried by said first adjustable means within the second arcuate path of said cam follower means and outside the first arcuate path of said cam follower means so as to be operable during the movement of said sprinkler body in said other direction of rotation when engaged by said cam follower means to move the latter out of said second position toward said first position for biased maintenance in said first position as aforesaid, second cam means mounted on said second adjustable means for movement between (1) a part-circle operative position within the first arcuate path of said cam follower means so as to be operable during the movement of said sprinkler body in said one direction of rotation when engaged by said cam follower means to move the latter out of said first position toward said second position for biased maintenance in said second position as aforesaid and (2) a full circle operative position out of said first arcuate path of said cam follower means so as to permit movement of said sprinkler body in said one direction with said cam follower means bias maintained in said first position through a multiplicity of rotations; and means for selectively moving said second cam means between said part-circle operating position and said full circle operating position to thereby selectively determine the mode of operation of said sprinkler head.

2. A sprinkler head as defined in claim 1 wherein said stationary means includes an annular member, said second adjustable means includes a carrier member mounted for annular sliding movement along said annular member and means carried by said carrier member and engageable with said annular member for fixedly securing said carrier member in any desired annular position of movement along said annular member.

3. A sprinkler head as defined in claim 2 wherein said second cam means includes a pivoted member mounted on said carrier member for pivotal movement about an axis spaced outwardly of said annular member in parallel relation to a tangent line touching said annular member at the position of fixed adjustment of said carrier member thereon and a cam element fixed to said pivoted member.

4. A sprinkler head as defined in claim 3 wherein said moving means for said second cam means comprises a spring-pressed overcenter toggle linkage operable to resiliently bias said cam element into limiting positions corresponding to said part-circle and full circle operative position from a center position intermediate thereof and for positively preventing movement of said cam element out of said part-circle operative position by engagement of said cam follower means therewith.

5. A sprinkler head as defined in claim 4 wherein said spring-pressed overcenter toggle linkage includes a bell crank lever pivotally mounted on said carrier member for movement about an axis parallel to the pivotal axis of said pivoted member, a link pivoted at one end to an arm of said bell crank lever and at its other end to said carrier member such that when said pivoted member is disposed in positions corresponding to said part-circle operative position and said full circle operative position the pivotal axis of said one end of said link is on opposite sides of a plane passing through the pivotal axis of the other end of said link and the pivotal axis of said bell crank lever.

6. A sprinkler head as defined in claim 5 wherein said spring-pressed overcenter toggle linkage further includes a spring operatively connected between said carrier member and said pivoted member for resiliently biasing the latter in one direction of pivotal movement.

7. A sprinkler head as defined in claim 6 wherein said spring-pressed overcenter toggle linkage further includes a single stop pin mounted in said carrier member in a position to be engaged by said pivoted member when said cam element is in a position corresponding to said full circle operative position and by said bell crank lever when said cam element is in a position corresponding to said part-circle operative position.

8. A sprinkler head as defined in claim 5 wherein said bell crank lever includes three lever arms, said link being pivoted to a lever arm disposed intermediate the other two lever arms, said other two lever arms having openings in the outer ends thereof for connection with actuating means.

9. A sprinkler head as defined in claim 1 wherein said moving means for said second cam means comprises a spring-pressed overcenter toggle linkage operable to resiliently bias said second cam means into limiting positions corresponding to said part-circle and full circle operative positions from a center position intermediate thereof and for positively preventing movement of said second cam means out of said part-circle operative position by engagement of said cam follower means therewith.

10. A sprinkler head as defined in claim 9 wherein said stationary means includes an annular member, said second adjustable means includes a carrier member mounted for annular sliding movement along said annular member and means carried by said carrier member and engageable with said annular member for fixedly securing said carrier member in any desired annular position of movement along said annular member.

11. A sprinkler head as defined in claim 10 wherein said second cam means includes a pivoted member mounted on said carrier member for pivotal movement about an axis spaced outwardly of said annular member in parallel relation to a tangent line touching said annular member at the position of fixed adjustment of said carrier member thereon and a cam element fixed to said pivoted member.

12. A sprinkler head as defined in claim 11 wherein said spring-pressed overcenter toggle linkage includes a bell crank lever pivotally mounted on said carrier member for movement about an axis parallel to the pivotal axis of said pivoted member, a link pivoted at one end to an arm of said bell crank lever and at its other end to said carrier member such that when said pivoted member is disposed in positions corresponding to said part-circle operative position and said full circle operative position the pivotal axis of said one end of said link is on opposite sides of a plane passing through the pivotal axis of the other end of said link and the pivotal axis of said bell crank lever.

13. A sprinkler head as defined in claim 12 wherein said spring-pressed overcenter toggle linkage further includes a spring operatively connected between said carrier member and said pivoted member for resiliently biasing the latter in one direction of pivotal movement.

* * * * *